US005282117A

United States Patent [19]

Fritts

[11] Patent Number: 5,282,117

[45] Date of Patent: Jan. 25, 1994

[54] LIGHT LEVELING MEANS FOR FLUORESCENT BACKLIT DISPLAYS OR THE LIKE

[76] Inventor: Robert W. Fritts, 1575 N. Second St., Stillwater, Minn. 55082

[21] Appl. No.: 895,276

[22] Filed: Jun. 8, 1992

Related U.S. Application Data

[63] Continuation-in-part of Ser. No. 763,624, Sep. 23, 1991, abandoned, which is a continuation-in-part of Ser. No. 573,475, Aug. 24, 1990, abandoned.

[51] Int. Cl.[5] ..... F21V 13/04

[52] U.S. Cl. ..... 362/223; 362/307; 362/311; 362/260; 362/147; 362/373

[58] Field of Search ..... 362/222, 223, 224, 307, 362/308, 309, 311, 326, 327, 328, 330, 332, 339, 97, 249, 260, 145, 147, 218, 367, 373

[56] References Cited

U.S. PATENT DOCUMENTS 4,267,489 5/1981 Morohashi ..... 40/361
4,335,421 6/1982 Modia et al. ..... 362/260
4,418,378 11/1983 Johnson ..... 362/248
4,691,276 9/1987 Giesberg ..... 362/373
5,038,259 8/1991 Katoh et al. ..... 362/256

*Primary Examiner*—Ira S. Lazarus
*Assistant Examiner*—L. Heyman
*Attorney, Agent, or Firm*—Joseph C. Schwalbach

[57] ABSTRACT

A method of providing uniform illumination of a light transmissive image on the light transmissive display panel of a fluorescent backlit display or the like, which includes blocking of a portion of the light flux projecting from at least one elongated tubular lamp toward the display panel in a plane including the lamp axis and normal to said panel; and blocking decreasing amounts of light flux projected from said lamp toward the display panel at points thereon spaced at successively greater distances on each side of said plane. A variable opacity light leveling mask configured to produce the aforementioned uniform illumination is interposed between the lamp and the display panel.

50 Claims, 9 Drawing Sheets

Fig. 13
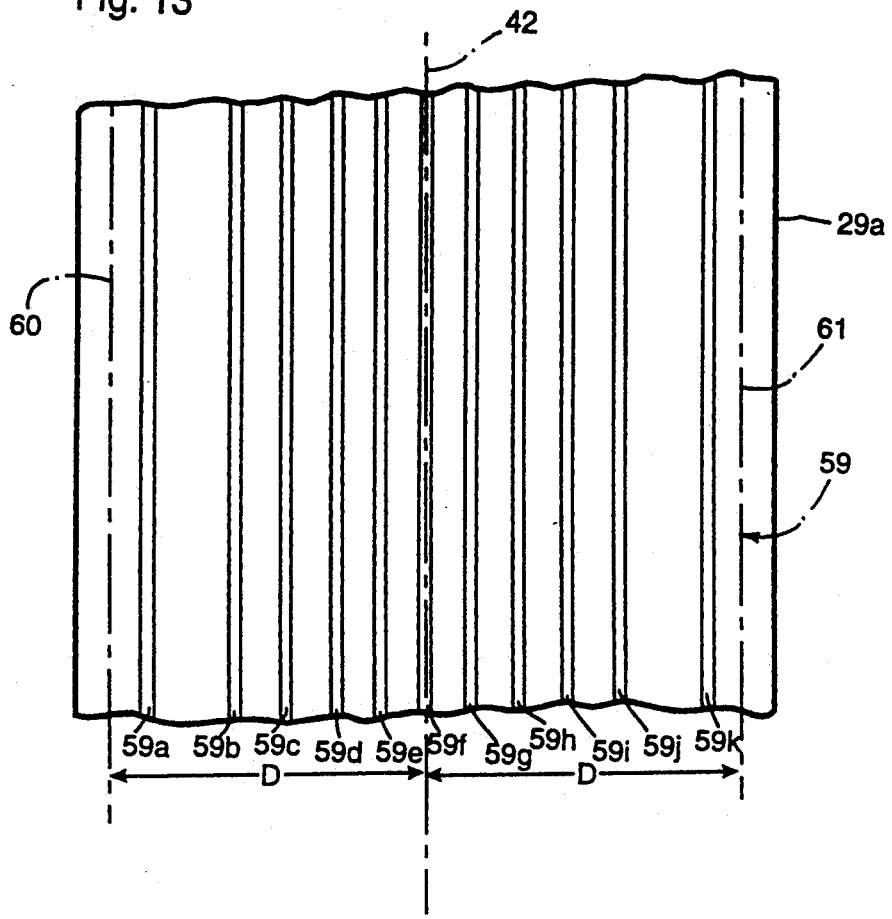
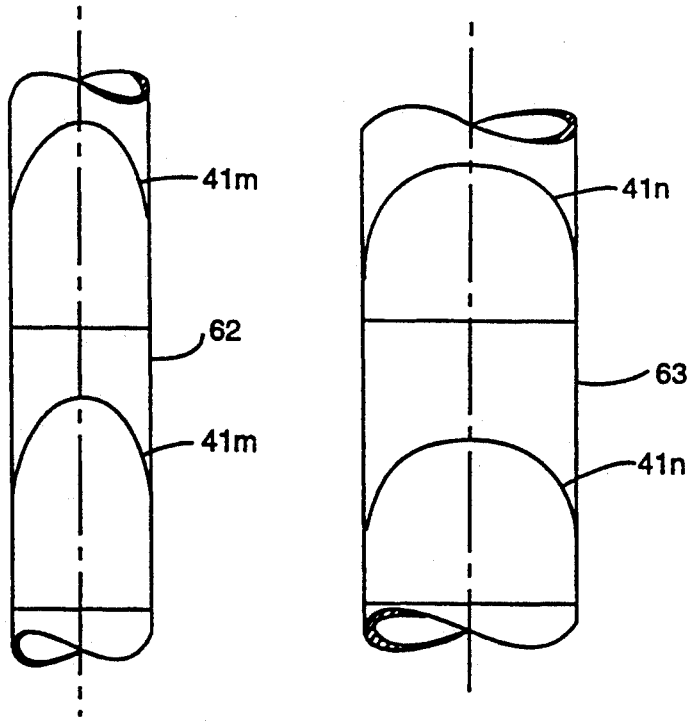
Fig. 14

LIGHT LEVELING MEANS FOR FLUORESCENT BACKLIT DISPLAYS OR THE LIKE

CROSS-REFERENCE

This application is a continuation-in-part of copending application Ser. No. 07/763,624 filed Sep. 23, 1991, now abandoned, which is a continuation-in-part of application Ser. No. 07/573,475, filed Aug. 24, 1990, now abandoned.

FIELD OF THE INVENTION

This invention relates in general to backlit displays, and more particularly to the illumination of a generally planar light transmissive image by light from a plurality of elongated tubular lamps in spaced parallel relation to each other and said image. The invention provides a variable opacity light leveling mask, a method, and a combination for providing illumination of the image at a brightness which appears uniform to the human eye.

DESCRIPTION OF THE PRIOR ART

Internally illuminated displays of the type with which this invention is concerned commonly utilize a light box incorporating therein an array of equally spaced parallel rectilinear fluorescent lamps behind a diffusely light transmissive white display panel adapted to bear a light transmissive image to be illuminated. Since the intensity of the light emitted from each lamp decreases as the reciprocal of the distance from the lamp axis, the density of the light flux projected from each lamp toward the display panel is highest directly in front of the lamp, i.e., in the plane normal to the display panel and including the lamp axis. As a result, in such displays the image is illuminated with an uneven brightness visible to the human eye, clearly exhibiting a plurality of spaced parallel straight line areas of high intensity in front of the lamps, and lower light level areas therebetween.

In an effort to provide more even illumination of a light transmissive image on the display panel, resort has been had to the practice of spacing the lamps close to one another and using a thick display panel made of optically relatively dense light diffusing white material. While this arrangement was an improvement of sorts, it suffered from a significant loss of lighting efficiency. A further disadvantage was the need for greater light box depth required to permit the closely spaced lamps to be moved away from the display panel to reduce the uneven brightness.

Eastman Kodak Co. booklet E-58, sold by photo dealers and entitled "Preparing Large Color Transparencies for Display" states on page 10 that, as a general rule the distance from the fluorescent tubes to the diffusing surface should approximately equal the spacing distance between the tubes. Following this rule, the ten inch spacing distance between adjacent tubes commonly used in large displays requires such displays to have a ten inch spacing between such tubes and the diffusing surface, and a corresponding light box depth of about twelve inches.

In order to alleviate uneven illumination of the display panel common to backlit displays of the prior art, a modified display panel was tried with limited success. This display panel was of laminate construction in which honeycomb type core or intermediate layer of light transmissive clear colorless polycarbonate was clad on each side with a continuous thin layer of the same type of polycarbonate. This construction also did not solve the problem in a satisfactory manner.

SUMMARY OF THE INVENTION

Testing has shown that image illumination exhibiting short range brightness variations of not more than plus or minus 2.5 percent appears uniform to the human eye. It is the provision of illumination with uniform brightness of that character which is meant when the term uniform illumination is used herein.

The present invention provides uniform illumination of a planar display panel, and of a planar light transmissive image overlying the same, with light from a light source in the form of at least one elongated tubular lamp, such as a fluorescent lamp, whose centerline or axis is generally parallel with the plane of the image. Uniform illumination is provided by blocking throughout the length of said lamp a first percentage, for example from about 22 percent to about 78 percent, of the light flux projected from said lamp toward said image in a plane including the lamp axis and normal to said image plane; attenuating said light flux blocking action with respect to light flux projected from said lamp toward said image at successively greater distances on each side of said plane normal to the image plane up to predetermined maximum distances; and permitting substantially unobstructed travel of light flux projected from said lamp toward said image at greater than said maximum distances.

The invention provides the aforementioned blocking of light flux from said lamp by the use of a variable opacity light leveling mask interposed between each lamp and the image. In the embodiments of the invention employing planar masks, the light blocked by the masks is diffusely reflected away from the image, and is then diffusely reflected toward the latter in areas between the lamps to provide improved luminous efficiency.

In the embodiments referred to, the variable opacity mask of the invention advantageously may comprise an array of spaced elongated tapered transversely extending coplanar light blocking element means of generally lenticular shape arranged along and transversely symmetrically normal to a longitudinal axis located in a plane normal to the image plane and which includes the lamp axis. The net width of each element means, i.e., the net dimension thereof parallel to said longitudinal axis, is at a maximum at said axis and provides maximum opacity with respect to light flux projected from the lamp toward the image plane thereat. The net width of the element means is gradually reduced at increasing distances on each side of said axis to provide attenuation of the aforementioned opacity which reaches zero at the outer extremities of said element means. The locations of the outer extremities of said element means define the marginal edges of the variable opacity mask and the effective width thereof, and they also correspond to the aforementioned maximum distances in the image plane on each side of the plane normal thereto and including the longitudinal axis of the mask.

The invention is well adapted to provide uniform illumination over the entire image area of large displays using many lamps. Moreover, the invention makes possible the uniform illumination of light transmissive images printed on white fabrics or diffuse white plastic films, without the need for conventional heavy rigid acrylic diffuser panels, thereby providing improved luminous efficiency, lower weight and lower construction cost.

The invention also provides substantial benefits to light boxes of the relatively larger sizes, for example those used for illumination of 8'×10' or 8' by 20' backlit images, which are frequently found in museums and theme parks. Such benefits include the aesthetic advantages of uniform illumination, shallower light box depth, for example five inch depth compared to the conventional twelve inch depth, and less massive construction.

Other and further advantages of the invention will appear to those skilled in the art as the description proceeds, reference being had to the accompanying drawings.

BRIEF DESCRIPTION OF THE DRAWINGS

In the drawings accompanying and forming a part of this application,

FIG. 13 is a fragmentary elevational view of another form of variable opacity planar mask of the invention;

FIG. 14 shows fragmentary elevational views of two different diameter tubular lamps, to the outer surfaces of which opaque cylindrical element means of the invention are adhesively laminated;

DESCRIPTION OF THE PREFERRED EMBODIMENT

Figure 1:
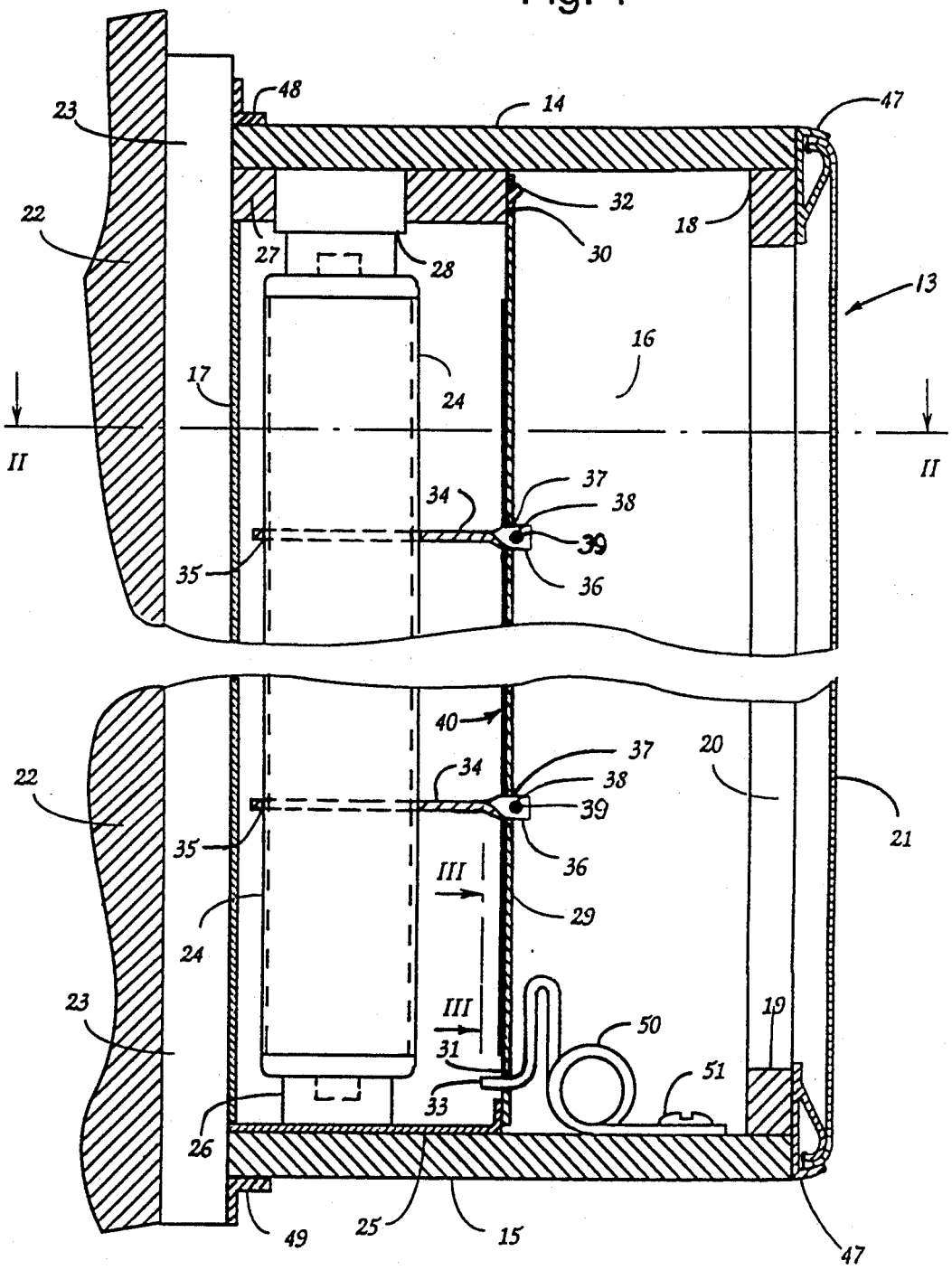
FIG. 1 is a fragmentary vertical sectional view taken through a fluorescent backlit display or light box incorporating a planar form of the variable opacity mask of the invention.

Referring now to FIG. 1 of the drawings, the numeral 13 indicates generally an internally illuminated backlit display or light box having a rectangular frame which may be made of any suitable material, such as wood or metal. The illustrated light box comprises top and bottom walls 14 and 15, a sidewall 16, an opposite sidewall (not shown), and a rear wall 17. The rear wall 17 is preferably formed of thermally conductive material, such as sheet aluminum, the inner surface of which is preferably coated with white, diffusely light reflective paint. The top, bottom and side walls also have inner surfaces that are preferably coated with white, diffusely light reflective paint to match the characteristics of the inner surface of the rear wall 17. Mounted on the inner surfaces of the top, bottom and side walls at the front edge thereof are top and bottom moldings 18 and 19, a side molding 20, and a corresponding opposite side molding (not shown).

Attached across the front of the light box 13 is a planar display panel 21 which may take the form of a white, diffusely light transmissive fabric. Alternatively, the display panel 21 can be formed of white, diffusely light transmissive plastic film. The display panel 21 may be secured to the frame of the light box by any suitable means, such as the extruded edge clamping strip 47 shown, or, for example, by hook/loop fastening strips, both of which are commercially available for this purpose. Attachment of the display panel to the light box in the manner described, effectively seals it against entry of dust laden air.

The display panel 21 is adapted to bear on its outer surface a light transmissive image (not shown). The preferred type of image is one which is flexible. It can be produced as a translucent photo on a film base, or it can take the form of a screen printed or computer spray painted image on the white fabric or translucent white plastic film forming the display panel 21. Any of these types of flexible image constructions can be used on the light box of the invention without the need for a conventional heavy, rigid, solid diffusion panel. However, if desired, a relatively light weight, thin gauge, solid, white diffusely light transmissive diffusion panel of plastic or glass may be used for the display panel 21.

Figure 2:
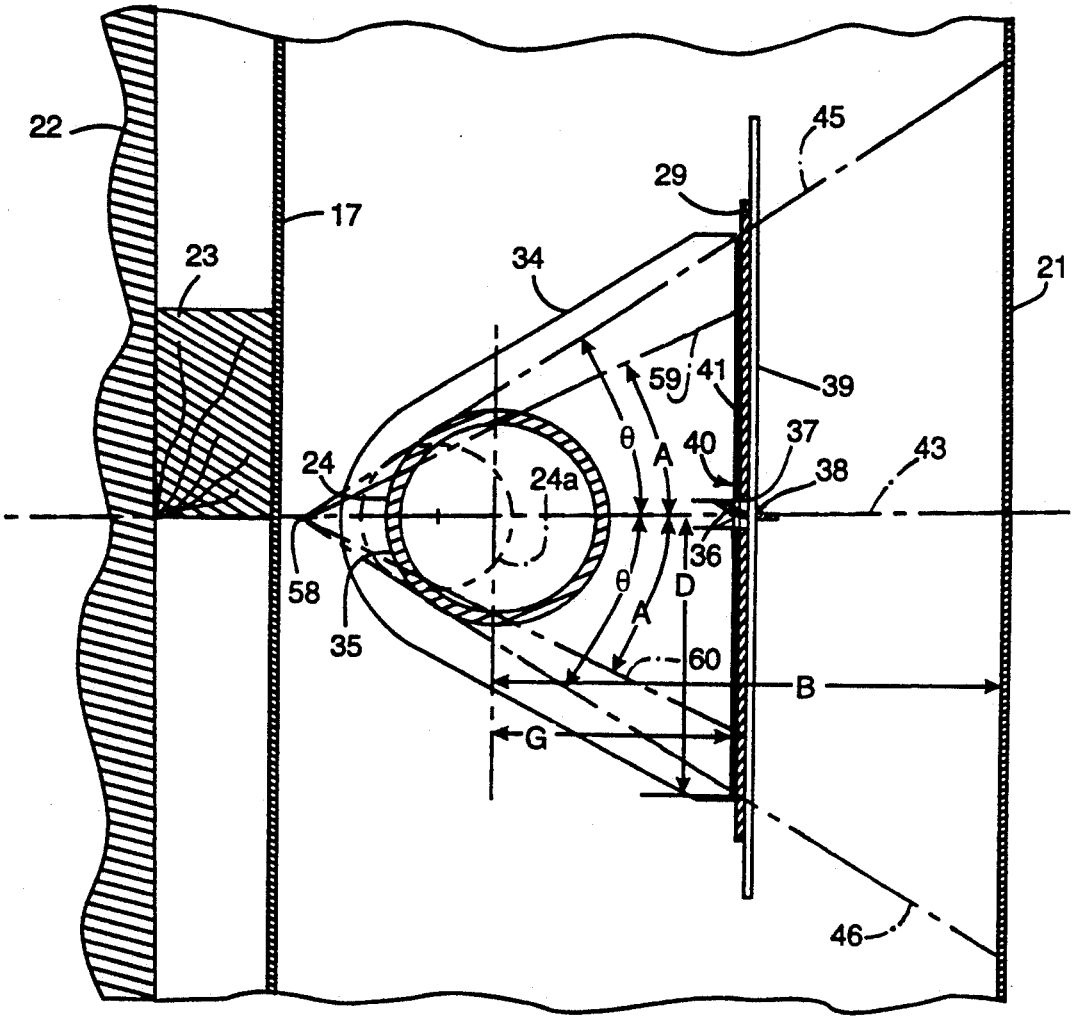
FIG. 2 is a fragmentary horizontal sectional view taken through the light box of FIG. 1 along the line II—II.

The light box 13 is suitably mounted on a supporting wall 22 or other support through upper and lower brackets 48 and 49 and at least two spaced apart vertically extending furring strips 23, only one of which is shown in FIGS. 1 and 2. It will be understood that the space between the light box rearwall 17 and the supporting wall 22, and between adjacent furring strips 23, provide a vertical channel which is open at both its upper and its lower end, and through which air can circulate to exhaust heat which passes through the heat conductive rear wall 17 from the interior of box 13.

The illustrated light box 13 has mounted therein a plurality of equally spaced, vertically extending elongated tubular lamps, which are parallel to each other and to display panel 21, and which preferably take the form of fluorescent straight line tubular lamps 24, only one of which is shown in FIGS. 1 and 2. Mounted on a spacer plate 25 suitably fixed to and overlying the bottom wall 15 adjacent the rear wall 17 is a static receptacle 26 for each of the lamps 24 and into which the respective lower ends of said lamps are received. Running along and secured to the inner surface of the upper wall 14 adjacent the rear wall 17 is a receptacle mounting member 27 which is apertured to receive a spring loaded upper receptacle 28 for each of the lamps 24. Appropriate ballast power supplies (not shown) are suitably mounted on an inner surface of one or more walls of the light box 13 at suitable positions facilitating short connecting wiring runs to the lamp receptacles.

Mounted between each lamp 24 and the display panel 21 is an elongated rectangular planar supporting plate or panel 29 of smooth-surfaced, clear, colorless light transmissive plastic, such as the plastic Plexiglas. Plexiglas is preferred because of its resistance to ultraviolet radiation which is emitted at low levels by fluorescent lamps. Each of the panels 29 is formed at its upper and lower ends respectively, with central apertures 30 and 31 and is supported at its upper end by a pin 32 projecting from the front face of the mounting member 27 and which is accommodated within the aperture 30.

In order to maintain each panel 29 parallel to the axis of its associated lamp 24, a plurality of spacer plates 34, also shown in FIG. 2, are provided for each panel 29. The spacer plates 34 are preferably made of stainless steel or aluminum and may be spaced along the lamp 24 at intervals of from about 24 to about 48 inches. As best shown in FIG. 2, each spacer plate 34 is generally triangular in shape and is apertured, as at 35, to receive the associated lamp 24 as shown. The front edge portion of each spacer plate 34 abuts the rear surface of panel 29.

The spacer plates 34 are each formed centrally of its forward edge with a projecting tab 36 having an opening 38 at its forward end. Each tab 36 projects snugly through an accommodating opening 37 formed centrally in panel 29. The panels 29 are held in abutment with the front edges of the spacer plates 34 by horizontally extending stainless steel wires 39 which pass through the respective openings 38 in tabs 36 and overlie the front surface of the panels 29. The wires 39 are held in tension by suitable securement, for example to the opposite side walls of the light box 13, or to suitable intermediate supports (not shown).

Each panel 29 is placed under longitudinal tension, for example by a helical spring 50 having a rearwardly extending horizontal end portion 33 which passes through the lower opening 31 in the respective panel. Springs 50 are each anchored, as by a screw 51, to the lower wall 15, so that the end portion 33 exerts a downward force creating the aforementioned longitudinal tension in panel 29. The springs 50, together with plates 34 and wires 39, cooperate to hold the panels 29 in fixed spatial relation with the lamps 24 and display panel 21.

Figure 3:
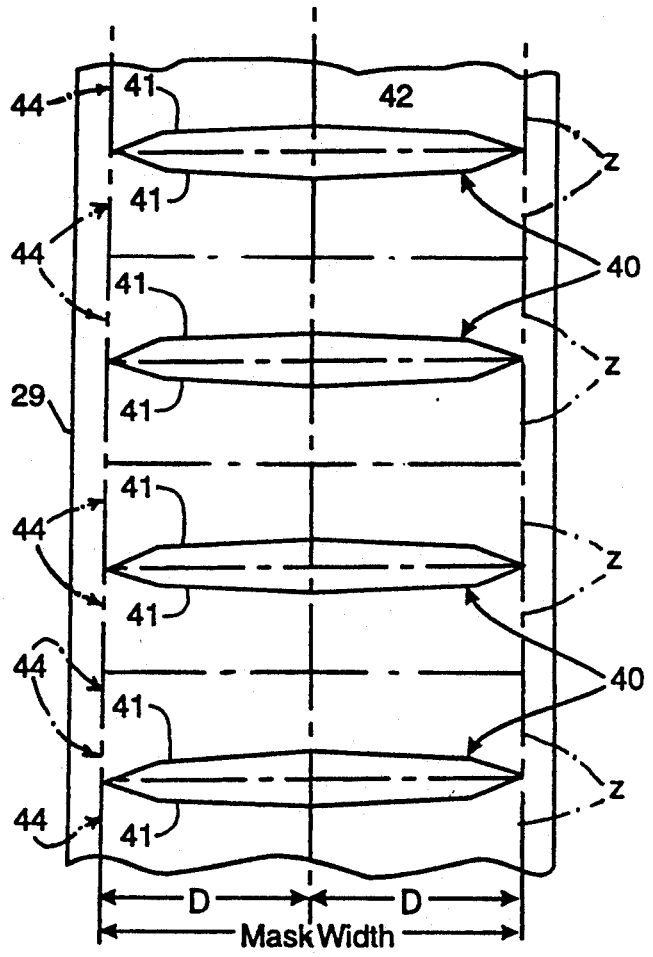
FIG. 3 is a fragmentary elevational view taken along the line III—III of FIG. 1 and illustrating a portion of one form of variable opacity mask useful in the invention.

The most important component of the present invention is a variable opacity light leveling mask, one form of which is indicated by the number 40 in FIGS. 1 to 3. The mask 40 is adhered to the surface of the panel 29 facing lamp 24 and is best shown in FIG. 3. It comprises an array of white, diffusely reflective elongated tapered element means 41 arranged along and transversely symmetrically normal to a longitudinal axis 42, which axis longitudinally bisects said mask and the elongated mask-supporting panel 29 and includes the lamp axis.

Figure 5:
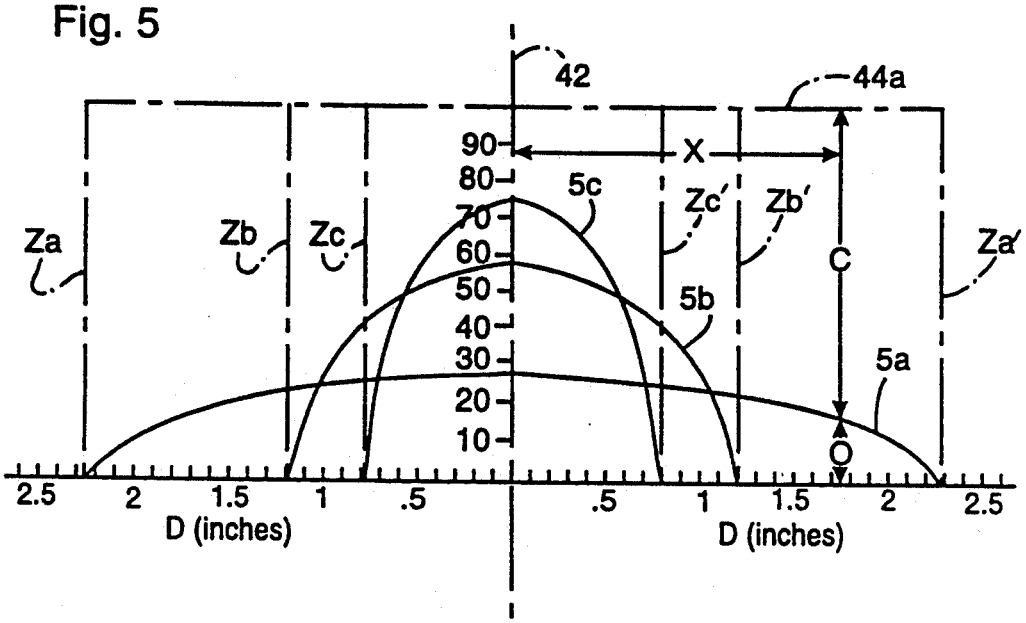
FIG. 5 shows curves which illustrate the percentage of light from an associated lamp which is blocked at all points across the effective width of three different masks of the invention.

In the mask 40 illustrated in FIG. 3 each element means 41 have a rectilinear shape which conforms substantially to the curvature of the curve 5*a* shown in FIG. 5, the latter generally resembling the shape of the diametrical cross section of a planoconvex lens. Each element means 41 has a flat edge and a convex edge and is located within a separate rectangular zone 44 having a length 2D and a width Z as shown. In FIG. 3, the element means 41 are arranged in back to-back relation, with the straight edges thereof abutting, to provide mated pairs having the general outline of the cross section a biconvex lens.

As illustrated in FIG. 3, the pairs of element means 41 are arranged generally in equally spaced relation along the axis 42 with the flat edges thereof normal to said axis, as shown. The axis 42 and the axis of the lamp 24 lie in the same vertical plane which is normal to the panel 29, mask 40, and display panel 21. This vertical plane is indicated by the dot and dash line 43 in FIG. 2.

The element means 41 are preferably formed from opaque diffusely light reflective film such as computer cut metal or opaque vinyl film which is adhered to the panel 29 with an appropriate adhesive. An example of one metallic film which is suitable for use for this purpose is Scotchcal No. 5430 brushed aluminum film available from 3M Company, Saint Paul, Minn. 55133. This film is provided with an adhesive backing facilitating attachment thereof to the surface on which it is to be mounted.

If desired, the mating pairs of element means illustrated in FIG. 3 can be cut as one piece having the illustrated biconvex lenticular shape. An alternative low cost method of producing the mask 40 illustrated in FIG. 3 is to screen print said mask on the panel 29 with white outdoor-type diffusely reflective sign paint. Here again the mating pairs of element means 41 can be printed as one unit having the illustrated biconvex lenticular shape. The outdoor-type white sign paint used for the element means 41 is also used on the inner surfaces of the light box rear wall, was well as on the inner surfaces of the top, bottom and side walls thereof. Such paint is resistant to the ultraviolet component of the fluorescent light produced by lamp 24.

The variable opacity mask 40 is continuous along the mask supporting panel 29 for the full length of the light emitting portion of the lamp 24. Since the element means 41 can overlie either surface of the supporting panel 29, all of said element means are substantially coplanar and are parallel with said supporting panel, as well as with display panel 21. The spacer plates 34 maintain the axis of lamp 24 at a fixed distance G, shown in FIG. 2, from the mask 40. Spacer plates 34 are preferably each attached to the supporting panel 29 in parallel alignment with the mating flat edges of a pair of element means 41 shown in FIG. 3.

In FIG. 5 the abscissa values represent the length of the element means 41 in inches, and the ordinate values represent percent opacity.

The curve 5*a* illustrates the percentage of light from an associated lamp 24 which must be blocked by variable opacity planar mask 40 throughout the length of said lamp for optimum light leveling effect. As indicated by curve 5a, maximum opacity, and therefore light blocking, occurs at the axis 42. Curve 5a exhibits the preferred opacity at axis 42 of 28 percent, the operative range for such opacity being from about 25 percent to about 31 percent of the light impinging upon the planar mask at axis 42. By virtue of the tapered configuration of the mask element means 41, such light blocking is symmetrically attenuated at increasing distances X on each side of said axis as indicated by the shape of curve 5a, reaching zero at the margins of mask 40, i.e. at the tips of element means 41.

In FIG. 5, the distance X shown is 75 percent of the distance from axis 42 to the adjacent margin of the mask, and the percentage of light blocked at that point, indicated by the letter O, is preferably from about 57 percent to about 67 percent of the maximum percentage at axis 42, or about 18 percent. The rectilinear element means 41 shown in FIG. 3 are shaped to conform to the curve 5a shown in FIG. 5, each having its convex edge formed by straight lines connecting the points generally on said curve at the axis 42, at the distance X=75 percent of an element means half length (0.75D) from axis 42, and at the adjacent outer tip of the element means 41.

The curve 5a shown in FIG. 5 has a rectangular zone 44a associated therewith which is similar to zones 44 in FIG. 3. The rectangle 44a is defined by the horizontal axis, the horizontal 100 percent opacity line and opposite ends Za and Za' which are spaced apart a distance 2D of about 4.5 inches. As will appear hereinafter this length is presently thought to be about the maximum practical length for element means 41.

In FIG. 5 the ordinate value of any point on a curve therein represents the net percentage of opacity thereat, and the abscissa value thereof is the horizontal distance in inches at which that point is spaced from the mask axis 42. Thus, at any point on curve 5a spaced from the axis 42, the net percentage of the light blocked by the mask 40 thereat is the percentage value below said curve, and the net percentage of the light which is unobstructed is that percentage value above the curve.

In the embodiment of the invention illustrated in FIG. 2, the lamp 24 shown in solid lines is a conventional type T12 lamp having a diameter of 1.5 inches. The more recently available type T8 lamp having a diameter of 1.0 inch is also useful with the present invention, it being illustrated in phantom line in FIG. 2 and indicated by the numeral 24a.

It is understood that when the type T8 lamp 24a is used instead of the type T12 lamp 24, appropriate apertures (not shown) corresponding to aperture 35 must be formed in spacer plates 34. Such apertures must be sized to snugly receive the T8 lamp 24a and are preferably positioned to receive the latter in the location thereof shown in FIG. 2.

The half length of an element means 41 of the mask 40 is indicated by the letter D in FIG. 2, and each such element means half length subtends an angle $\theta$ on its respective side of the vertical plane 43. The angles $\theta$ are defined by vertical planes illustrated by the dot and dash lines 45 and 46 in FIG. 2, which planes are tangent to the perimeters of lamps 24 and 24a and intersect each other and plane 43 at the vertex 58. The angles $\theta$ are preferably about 34 degrees and have an operative range of from about 31 degrees to about 37 degrees. The distance G between the lamp axis and the mask axis 42 has a range of from about 0.75 to about 2.0 inches when the type T12 lamp 24 is used, and a range of from about 0.5 to 2.0 inches when the type T8 lamp 24a is used with the planar mask illustrated in FIGS. 1 to 3.

When the planar mask 40 is moved between its minimum and maximum positions with respect to the lamps 24 or 24a, without changing the angles $\theta$, the planes 45 and 46 represent the approximate locus of the margins of the mask 40, and the element means 41 half length D changes correspondingly, for example generally as follows:

| Lamp Diameter (inches) | G (inches) Minimum | G (inches) Maximum | Corresponding D (inches) | Ratio G/D |
|---|---|---|---|---|
| 1.0 | .5 | | .95 | .53 |
| 1.0 | | 2.0 | 2.0 | 1.0 |
| 1.5 | .75 | | 1.4 | .54 |
| 1.5 | | 2.0 | 2.25 | .89 |

When the distance G is varied as described, the element means half length D varies generally as indicated above, but the net width of said element means at the axis 42, as well as at the locations spaced from said axis the distance 0.75D, remain substantially unchanged.

In this connection the numerals 59 and 60 in FIG. 2 indicate vertical planes which at one end intersect the vertex 58, and at the other end intersect the element means 41 at the distances 0.75D on each side of axis 43. The planes 59 and 60 form angles A with the plane 43 as shown in FIG. 2 and represent the approximate locus of 0.75D points of mask 40 as said mask is moved toward or away from the lamp.

Variation in the net width of element means 41 must be made to compensate for variation in the light transmittance characteristics of the different materials which can be used therefor. Most available vinyl films and most screen printing paints are not truly opaque. The light transmittance of vinyl films can range from zero percent to about 30 percent, whereas the light transmittance of paint can range from about 20 percent to about 50 percent. Metal, on the other hand, being truly opaque, has zero light transmittance. The configuration of an element means 41 which is used depends upon the light transmittance of the material from which it is made. For example, in order to provide a given light blocking effect, element means made of material exhibiting relatively high light transmittance must have a greater net width than those made of material exhibiting relatively low light transmittance.

In addition to variations in the materials from which element means 41 are made, another factor affecting the configuration required for the element means 41 is the smoothness of the surfaces of carrier plate 29. Such surfaces are usually somewhat reflective of light and thereby produce a light blocking effect which is additive to that of the element means 41. Therefore, when a given total light blocking effect is required to be produced at axis 42, the selected net width of element means 41 at said axis must produce a light blocking effect which, when combined with the light blocking effect produced by plate reflectivity, provides the required total light blocking effect at axis 42.

Figure 6:
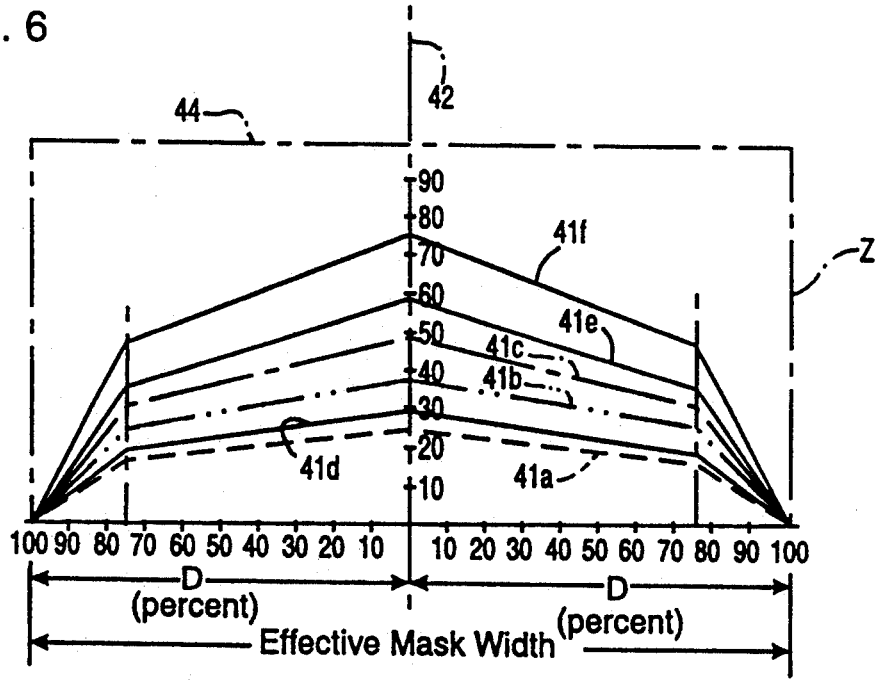
FIG. 6 illustrates in broken lines various configurations of planar element means of variable opacity masks of the invention which can be utilized when said element means are mounted on a clear colorless carrier plate and are made of material which is opaque or has various degrees of light transmittance, said figure also illustrating in solid lines the configurations of various opaque metal element means.

FIG. 6 is similar to FIG. 5 except that the element means therein are rectilinear like those in FIG. 3, and the horizontal coordinates are stated in terms of percent D from zero to one hundred. FIG. 6 illustrates in part variations in planar element means configuration required to produce a given light blocking effect using element means 41 formed of different materials and mounted on a clear colorless reflective carrier plate like plate 29 in FIG. 3. In this Figure, the broken line 41*a* represents the configuration of an element means made, for example, of opaque vinyl (zero light transmittance) on Plexiglas. Broken line 41*b* represents the configuration of an element means made of paint which has a light transmittance value of 33%, on Plexiglas. Broken line 41*c* represents the configuration of an element means made of paint which has light transmittance value of 50%, on Plexiglas. Solid line 41*d* represents the configuration of a self supporting opaque metal element means which is not mounted on a reflective carrier plate. The element means 41*d* configuration conforms substantially with curve 5*a* in FIG. 5, inasmuch as it has the same opacity characteristics at the axis 42 and at the points 0.75D as curve 5*a*.

It will be observed from FIG. 6 that when the element means are made of materials which are light transmissive, the dimension parallel to axis 42 must be increased inversely with light transmittance, as shown by the contours of element means 41*b* and 41*c*, in order to produce the given light blocking effect. The contour of element means 41*a* illustrates the reduction in the dimension parallel to axis 42 compensating for the reflectivity of carrier plate 29 when a totally opaque element means is mounted thereon. The amount of such compensation is apparent by a comparison of the contour of element means 41*a* with that of element means 41*d*. Both are totally opaque but the element means 41*d* is not mounted on Plexiglas.

Figure 4:
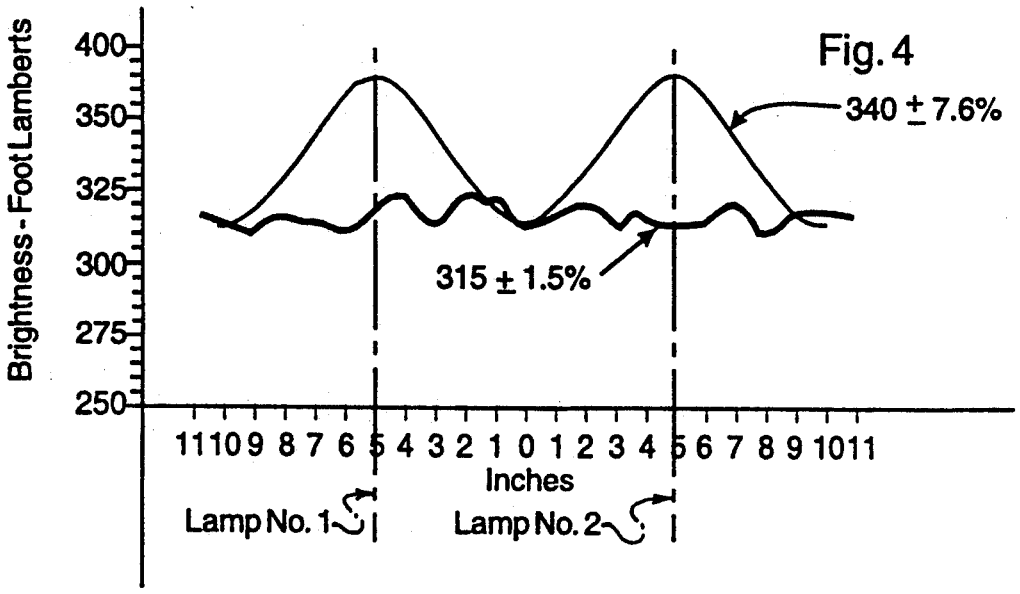
FIG. 4 shows curves which respectively illustrate the brightness with which the display panel of a conventional backlit display or light box is illuminated by two fluorescent lamps, and the brightness with which the same display panel is illuminated when variable opacity light leveling masks of the invention are employed.

FIG. 4 provides a graphic representation of the intensity of light with which the display panel of a 5 inch deep light box is illuminated by light from a pair of fluorescent lamps whose axes are spaced apart 10 inches and are spaced from the display panel about 3.5 inches. Spot photometer measurements across the display panel surface were productive of the sinusoidal upper curve in FIG. 4 which represents a brightness pattern across the display panel surface exhibiting a variation of about 15 percent between peaks and valleys. A brightness variation of this magnitude is aesthetically objectionable to the human eye.

A variable opacity mask 40 of the present invention was then inserted in operative position between each fluorescent lamp and the display panel, spaced a distance G in FIG. 2 of 1.75 inches. The element means 41 of said mask had a length 2D (in FIG. 2) of 4 inches and a width at axis 42 of 0.3 inches, and the zone width Z was 1.0 inch. The element means 41 were made of vinyl film which had a light transmittance of 33%, said element means having the general configuration of curve 41*b* in FIG. 6, and were mounted on a Plexiglas carrier plate 29 as shown in FIG. 3.

With the light leveling mask in place, the spot photometer measurements were repeated, and the resulting data were productive of the lower curve in FIG. 4. That curve represents a modulated or leveled brightness pattern across the front of the display panel. This modulated brightness pattern exhibits a brightness variation of only about 1.5 percent between peaks and valleys and the mean value therebetween, a 90 percent reduction in the brightness variation exhibited in the upper curve, and well below the 2.5 percent brightness variation level which is discernable to the human eye.

Referring now to FIG. 2, light flux is radiated in all radial directions from the lamp 24. The light flux which is directed forwardly toward the display panel 21 most strongly affects the non-uniformity of illumination of that panel's surface in conventional light boxes. The light flux projecting from opposite sides of the lamp in FIG. 2, direct light to areas of the panel farther removed from the lamp than those illuminated by the forwardly directed light flux, and thus contribute less light intensity near the lamp than the forwardly projected light flux.

The light flux directed rearwardly toward the diffusely reflective rear wall 17 is redirected forwardly toward the display panel 21 through the spaces between the lamps. Thus, the sidewise and rearwardly-directed light flux contribute light to a much larger area of the display panel 21 than the area directly illuminated by the forwardly directed light flux. However, with respect to the light flux directed rearwardly and redirected forwardly, the lamps themselves, being of white glass, act to block some of that light flux from reaching the display panel directly. This light blocking action is also additive to the light blocking action of the element means 41 at axis 42 and must be taken into account in the selection of a net width for the element means used. The element means net width selected must produce a light blocking effect which, when combined with the aforementioned light blocking action of the lamp 24 and of panel 29, produces only a light leveling amount of such light blocking action, and not so much that it tends to produce shadows on the display panel in front of the lamp.

To accomplish the control of the light projected forwardly from the lamps in such a way as to produce the uniform illumination demonstrated in the lower curve of FIG. 4, the present invention utilizes the variable opacity masks 40 which function to block, in a controlled manner, the light flux passing therethrough. As demonstrated by that lower curve, the intensity of the light incident upon the display panel 21, and any image thereon, is uniform within a 1.5 percent variation in brightness at all points on said panel within the angles $\theta$ shown in FIG. 2. The mask 40, produces such uniform illumination by virtue of its ability to block the light flux projected toward the portion of the panel 21 most directly in front of the lamp, i.e., in the area of the plane 43 and the mask axis 42, and to attenuate such blocking at increasing distances on said panel outwardly from said plane, up to maximum distances defined by the intersection of planes 45 and 46 with said panel at the angles $\theta$ shown in FIG. 2.

The element means 41 of the mask 40 produce a light transmission coefficient which varies with the distance X (in FIG. 5) at which light flux from the lamp intersects the element means 41. This light transmission coefficient is represented by the curve 5*a* shown in FIG. 5, which adjusts the ratios of the clear and opaque areas of zone 44*a* to increase the net width of the clear area and decrease the net width of the opaque area as the distance X increases.

Because the rectilinear fluorescent lamps 24 and 24*a* are extended light sources, the dimension Z of the respective zones 44 is not critical, within relatively broad limits. The presently preferred dimension for Z is from about 1.0 inch to about 2.0 inches. However, it should not exceed more than about 2.5 inches. Exceeding this limit may cause vertical shadow development on the display panel 21 in general alignment with the axis of the associated lamp. Such shadows tend to occur when the zone dimension Z is greater than the distance between the display panel 21 and the mask 40.

Figure 7:
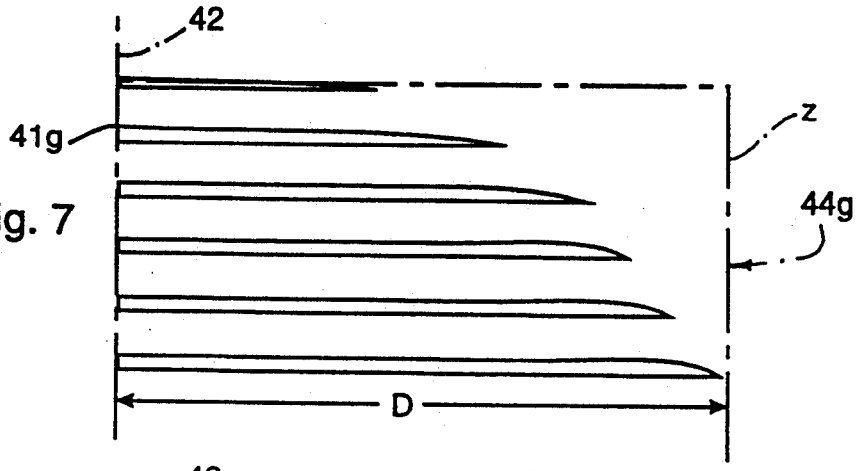
FIG. 7 illustrates an alternative configuration of a half element means of a variable opacity mask of the present invention formed of transverse sections spaced apart in the direction of the longitudinal axis of the mask.

FIGS. 7 to 13 illustrate several alternate configurations of the element means 41 of the present invention. FIG. 7 illustrates one half of an element means 41*g* which has been split normal to mask axis 42 into a multiplicity of parallel sections which are spaced apart in the direction of axis 42 sufficiently to occupy the full width Z of the respective rectangle 44*g*. While the element means 41*g* illustrated in FIG. 7 appears to be quite different from the element means 41 in FIG. 3, both element means function in a substantially identical manner, since the net width of the sections of the element means 41*g* at any point along the length thereof is substantially identical with that of element means 41 at the same distance from the mask axis 42.

Figure 8:
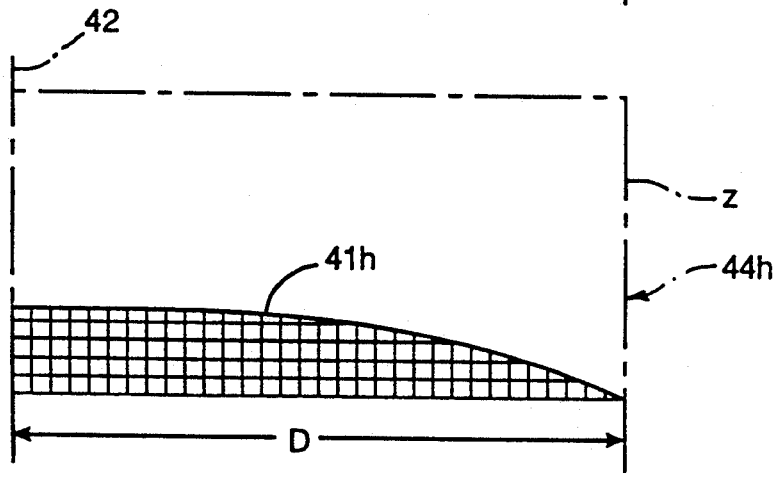
FIG. 8 illustrates how the configuration of a half element means of the variable opacity mask of the invention can be digitized to facilitate the production of equivalent alternate configurations thereof.

FIG. 8 illustrates how a half element means 41*h*, which is within zone 44*h* and conforms generally to the shape of the curve 5*a* shown in FIG. 5, can be digitized into sections by the square cross-sectioning shown.

Figure 9:
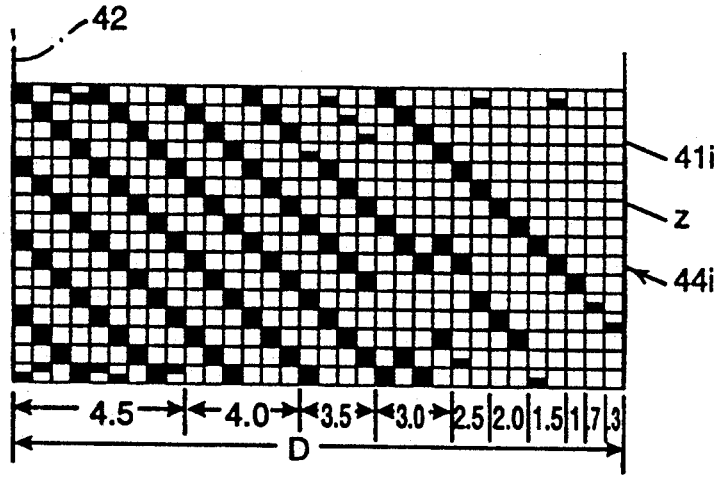
FIG. 9 illustrates an alternate configuration of a mask half element means derived from the digits in the half element means of FIG. 8.

FIG. 9 illustrates how a half element means 41*i*, having the same identical net width throughout its length as element means 41*h* in FIG. 8, can be produced by dissecting element means 41*h* along the cross-sectioning lines thereof and mounting the resulting individual digital squares and other shapes on a Plexiglas plate carrier within a rectangular zone 44*i* which is identical to zone 44*h* in FIG. 8. The individual digits are arranged within contiguous rows parallel with axis 42, each row containing the number of squares or digits which are contained in the corresponding row of the element means 41*h* in FIG. 8. The rows which contain the same number of digits, and the number of digits per row, are indicated along the lower edge of zone 44*i* in FIG. 9. The illustrated positions of the digits in each row are arbitrary, it being a matter of choice where in a given row the digits are located, so long as they are not superimposed upon one another.

It will be apparent that the net width of the opaque portions in any one of the rows in element means 41*i*, i.e., the total net area of the dark digits therein, is substantially identical to the net width of the corresponding row in element means 41*h*. While the digits illustrated FIGS. 8 and 9 are square, it is understood that they can be any other desired shape, such as hexagonal, circular or irregular, so long as the described substantially identical relationship of the net widths in corresponding rows is retained.

The size of the digits is not critical and can be very small. One example of the latter is a mask comprising contiguous zones, like zones 44 in FIG. 3, in which a multiplicity of light blocking particles is dispersed within a light transmissive matrix covering said zones. In accordance with the invention, the concentration or density of such particles should be greatest at mask axis 42 and should gradually decrease in size and/or density at increasing distances from axis 42 in the same general manner as the digits in FIG. 9. The distribution of such particles is preferably such as to impart to the mask the attenuated opacity or light blocking characteristic of the type represented by the curve 5*a* in FIG. 5.

The photographic art lends itself to the production of masks of this type, in view of the fact that photographic films exhibiting continuously variable tonal opaque/-transmittance ranges are routinely produced by exposure control. For example, a variable opacity planar mask produced by a photographic process can have a width 2D of about 4.0 inches, a net opacity of about 28 percent at axis 42, a net opacity of about 18 percent at distances of about 1.5 inches on each side of axis 42, and an opacity of zero at the margins, i.e., at a distance of about 2.0 inches on each side of axis 42.

Figure 10:
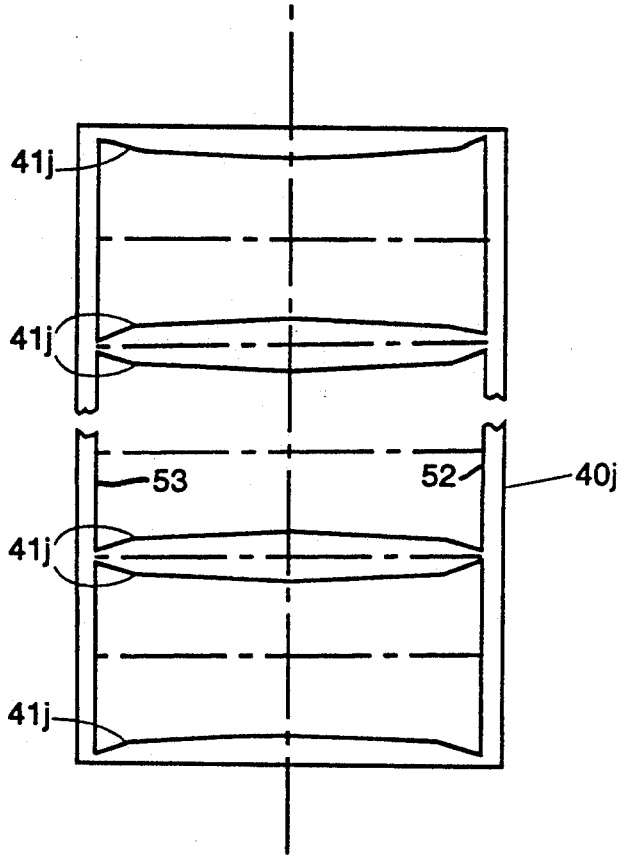
FIG. 10 is an elevational view of a planar form of metallic variable opacity mask of the invention.

FIG. 10 illustrates a planar mask 40*j* which is self supporting and therefore requires no carrier such as the carrier plate 29 shown in FIGS. 1 to 3. The illustrated mask 40*j* is preferably opaque and may be made of metal. It may take the form of a planar sheet metal stamping in which the element means 41*j* are connected at their ends by means of integral parallel connecting strips 52 and 53.

The configuration of the element means 41*j* of planar mask 40*j* preferably exhibits the opacity characteristics of curve 5*a* in FIG. 5 and conforms to the configuration of element means 41*d* shown in solid lines in FIG. 6. As shown in FIG. 6, the net width of element means 41*d* differs in various degrees from those of the element means 41*a*, 41*b* and 41*c*, all of which are mounted on Plexiglas. The connecting strips 52 and 53 are preferably bent into radial alignment with the associated lamp to minimize interference with radial light flux therefrom.

The mask 40*j* may have a length to extend the full length of the lamp with which it is to be associated in use, or it may be formed in sections of, for example, 12 inches in length, to provide a mask which is modular and can accommodate lamps of different length. In the latter case suitable connecting means (not shown) can be provided for assembly of the mask in the desired number of sections. Suitable means (not shown) should also be provided for mounting mask 40*j* in tension similar to the mounting of carrier panel 29 in FIGS. 1 and 2.

FIG. 13 illustrates still another planar mask in accordance with the invention which takes the form of a linear array of spaced opaque element means parallel with the axis 42. In FIG. 13 the mask 59 comprises the element means 59*a* through 59*k* which are in the form of opaque linear strips having a generally uniform width of about 0.060 inch. These strips are applied, for example, to a Plexiglas panel 29*a* which is similar to panel 29 in FIGS. 1 and 2, and are spaced from each other in the direction normal to said axis. The middle strip 59*f* is bisected by the mask axis 42, and strips 59*e* and 59*g* have their centerlines spaced about 0.25 inch from said axis. Strips 59*d* and 59*h* have their centerlines spaced about 0.51 inch from axis 42, and strips 59*c* and 59*i* have their centerlines spaced about 0.78 inch from said axis. The strips 59*b* and 59*j* have their centerlines spaced about 1.07 inch from axis 42, whereas strips 59*a* and 59*k* have their centerlines spaced about 1.55 inch from said axis.

It will be apparent that the spacing between the strips becomes successively larger as the distance from axis 42 increases. More specifically, the distance between adjacent strips, going outwardly from the center strip 59*f* in both directions, increases in inches about as follows, 0.19, 0.20, 0.21, 0.23 and 0.42. The outermost strips 59*a* and 59*k* are positioned with their centerlines a distance of about 0.17 inch from the respective adjacent margins 60 and 61 of mask 59.

The number of strips, the strip width, and their spacing from the mask axis were mathematically derived from the opacity curve 5*a* in FIG. 5, adjusted for mounting on Plexiglas per curve 41*a* in FIG. 6. Thus the mask 59 exhibits maximum opacity in the area of axis 42, and successively reduced opacity at increasing lateral distances from said axis, such opacity reaching substantially zero at the margins 60 and 61 of said mask. The planar mask 59 may be used at the lamp to mask distances G in FIG. 2 for which the corresponding mask width 2D is about 3.5 inches.

It will be apparent to those skilled in the art that, if desired, the same general opacity characteristics can be provided by a planar mask (not shown) of the general type shown in FIG. 13 wherein an opaque strip of predetermined maximum width is bisected by the axis 42. In such a mask, strips of the same material and having successively narrower width are in spaced parallel relation therewith and with each other on each side of said axis to provide successively decreased opacity in general conformance with the characteristics of curve 41a in FIG. 6.

The planar masks aforedescribed work well with the type T8 and type T12 fluorescent lamps presently available for such use. Both types of lamps have similar characteristics of power consumption, luminous output and long life. The T12 lamp has been the standard for many years, whereas the smaller diameter T8 equivalent has emerged recently with the growing sophistication of the fluorescent lamp industry. The T8 lamps are available from Osram Corporation, 110 Bracken Road, Montgomery, N.Y. 12549, as OSRAM T8/FO Trichrome fluorescent lamps.

As an alternative to the flat or planar configuration of the opaque mask 40*j* shown in FIG. 10, the invention also contemplates a cylindrical mask which overlays the surface of the associated lamp in generally coaxial relation. One form of cylindrical mask is adhesively applied in laminate relation directly to the outer surface of the lamp 24 or 24*a*. Such a cylindrical mask preferably comprises element means formed of the adhesive backed opaque vinyl film or the adhesive backed aluminum foil referred to earlier herein. Alternatively, the cylindrical mask may take the form of a metallic sleeve-like structure adapted to have a snug coaxial clamping fit around the lamp with which it is to be associated.

Testing has shown that, in order to accomplish the objectives of the invention, a cylindrical mask of this general type must utilize element means which have a net width at axis 42 which is significantly greater than those utilized in the planar masks described earlier herein. While the reason for this is not completely understood, it is believed that it is caused, at least in part, by the fact that the cylindrical shaped element means do not project into the path of light flux reflected from the light box rear wall toward the display panel through the space between the lamps.

Since the cylindrical mask element means have no substantial blocking effect on such reflected light comparable to that of the planar masks, the light blocking effect of the element means on light flux directed fowardly from the lamp must be increased to avoid undesirable levels of brightness on the display panel. To this end, the net width of the cylindrically shaped element means must be increased, both at the axis 42 and at the points thereon spaced the distance 0.75D therefrom.

The curve 5*b* in FIG. 5 and element means 41*e* illustrate the increased net width required for the element means of a cylindrical mask useful on a T12 (1.5 inch diameter) lamp. The rectangle corresponding to rectangle 44*a* and with which the curve 5*b* is associated has a considerably reduced length corresponding to the half circumference of a T12 lamp and defined by the vertical lines Zb and Zb' in FIG. 5. Curve 5*b* in FIG. 5 exhibits the preferred opacity at axis 42 of 58 percent, the operative range of which is from about 55 percent to about 61 percent. Curve 5*b* also exhibits an opacity at the 0.75D points of 35 percent, the operative range of which is from about 32 percent to about 38 percent.

When a cylindrical mask is applied to a type T8 lamp, the net width of the mask element means at the axis 42 and at the 0.75D distances therefrom must be even greater than that of the mask used on the T12 lamp. One reason for this requirement is believed to be that light directed rearwardly from the T8 lamp and generally normal to the light box rear wall, upon reflection forwardly therefrom toward the image plane, is blocked by the silhouette of the T8 lamp to a lesser degree than it is blocked by the wider silhouette of the T12 lamp. The greater element means net width is therefore required of cylindrical masks used on the T8 lamps in order to avoid undesirable levels of brightness on the display panel.

The curve 5*c* in FIG. 5 illustrates the increased net width required of the element means of a cylindrical mask useful on a T8 (1.0 inch diameter) lamp.

The rectangle corresponding to rectangle 44*a* and with which the curve 5*c* is associated has a further reduced length which corresponds to the smaller half circumference of the T8 lamp. The length of the last mentioned rectangle is defined by the vertical lines Zc and Zc' in FIG. 5. Curve 5*c* in FIG. 5 exhibits the preferred opacity at axis 42 of 78 percent, the operative range of which is from about 75 to about 81 percent. Curve 5*c* also exhibits an opacity at the 0.75D points of 47 percent, the operative range of which is from about 44 percent to about 50 percent.

Figure 11:
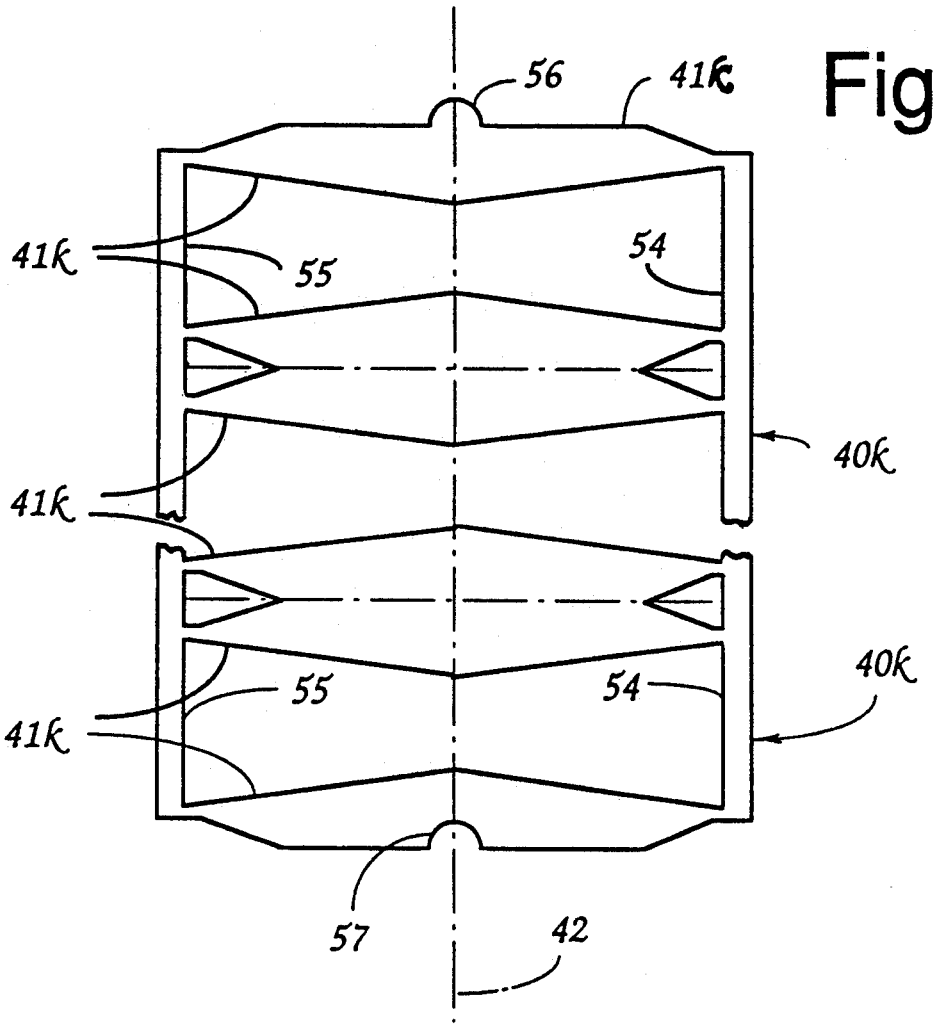
FIG. 11 is an elevational view of a planar blank at an intermediate stage in the manufacture of another form of metallic variable opacity mask of the invention.

FIG. 11 illustrates a planar blank from which a cylindrical metal mask 40k useful on a type T12 lamp can be formed. It will be observed that the blank shown in FIG. 11 is generally similar to mask 40*j* in FIG. 10 but has element means of substantially greater net width. Mask 40*k* comprises a plurality of element means 41*k* in spaced back-to-back pairs which are connected at their ends by integral parallel connecting strips 54 and 55. The element means 41*k* in FIG. 11 preferably exhibit substantially the opacity characteristics of curve 5*b* in FIG. 5 and conform to the configuration of the element means 41*e* shown in solid lines in FIG. 6, the ends thereof being somewhat modified to provide a structurally more rigid unit.

The final fabrication step for mask 40*k* involves forming the blank of FIG. 11 into a cylindrical shape having a diameter of 1.5 inches. In the forming step the connecting strips 54 and 55 are turned outwardly in a radial direction with respect to the lamp 24 as shown in FIG. 12, thereby minimizing interference with radial light flux emanating from lamp 24.

In the mask 40*k* the element means half length D is slightly greater than the half circumference of the lamp it is to be associated with. For example, for use with a T12 lamp D is 3.2 inches. Since, the half circumference of a T12 lamp is 2.4 inches, the metallic array is provided with an overlap of 0.4 inch on each side of the lamp, or a contact angle of about 125 degrees on each side of the vertical plane 43, for lock-on purposes.

Figure 12:
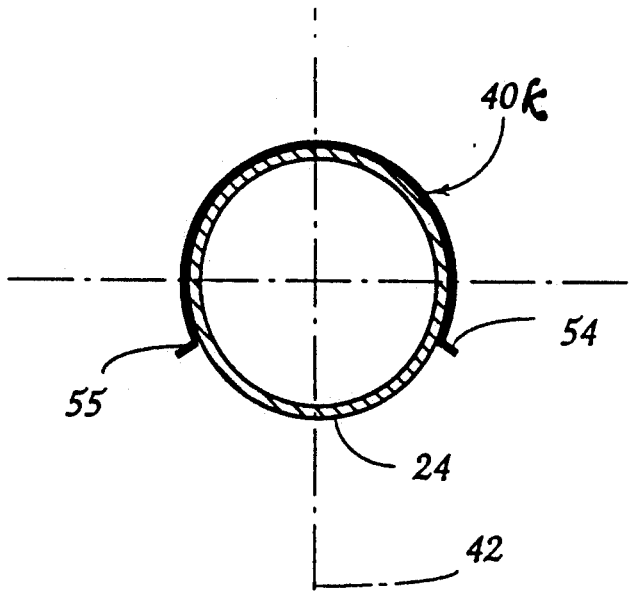
FIG. 12 is a transverse sectional view showing the blank of FIG. 11 formed into a cylindrical shape and in operative position in clamping engagement around an associated tubular lamp.

In order to provide a metal mask of the type shown at 40*k* in FIGS. 11 and 12 for use on the T8 type lamp, the element means thereof are made somewhat shorter to compensate for the smaller lamp circumference, and the net width of said element means must be increased both at the axis 42 and at the 0.75D points to avoid undesirable levels of brightness on the display panel. Curve 5*c* in FIG. 5 exhibits both the increased element means width and shortened element means length required for cylindrical masks useful on T8 lamps. The element means 41*k* shown in FIG. 11 which are useful on T8 lamps preferably exhibit substantially the opacity characteristics of curve 5*c* and conform to the shape of element means 41*f* in FIG. 6.

The mask 40*k* may advantageously be formed in sections which are 12 inches long, thus permitting the use of multiple abutting mask sections to longitudinally clad fluorescent lamps which come in multiples of 12 inch lengths. The individual sections have interlocking tabs 56 and notches oriented along the mask axis 42 as shown to insure proper relative orientation of adjacent sections. The masks 40*j* and 40*k*, whether sectional or not, must be carefully installed so that the longitudinal axis thereof is in plane 43 in FIG. 2 which is normal to the display panel and includes the lamp axis.

In FIG. 14 there is illustrated in fragmentary elevation, a T8 type lamp 62 and T12 type lamp 63 having adhered to the surface thereof cylindrical element means 41*m* and 41*n*, respectively, both of which are formed of opaque flexible vinyl film or metallic foil of the type referred to earlier herein. The element means 41*m* and 41*n* respectively conform in shape and exhibit the opacity characteristics of curves 5*c* and 5*b* in FIG. 5. Thus, element means 41*m* and 41*n* have curvilinear shapes, rather than the rectilinear shapes of the element means 41*f* and 41*e* shown in FIG. 6 and of the element means 41*k* of mask 40*k* shown in FIG. 11.

Figure 15:
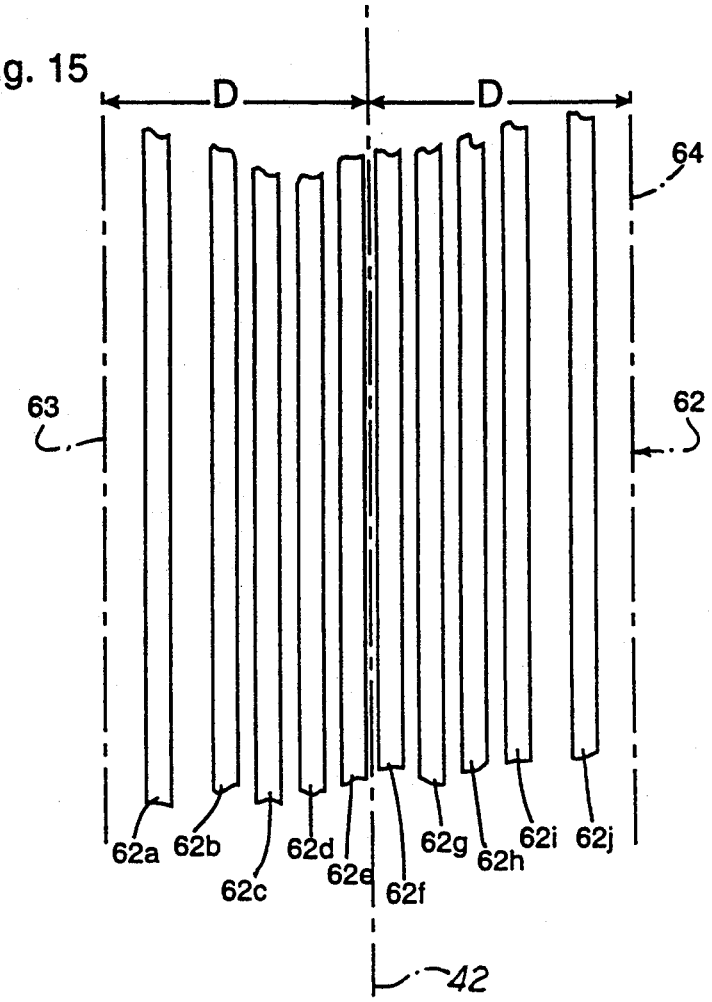
FIG. 15 is a fragmentary elevational view of a form of mask similar to that shown in FIG. 13 and which is adapted to be applied directly to the outer surface of a tubular cylindrical 1.5 inch diameter lamp.
Figure 16:
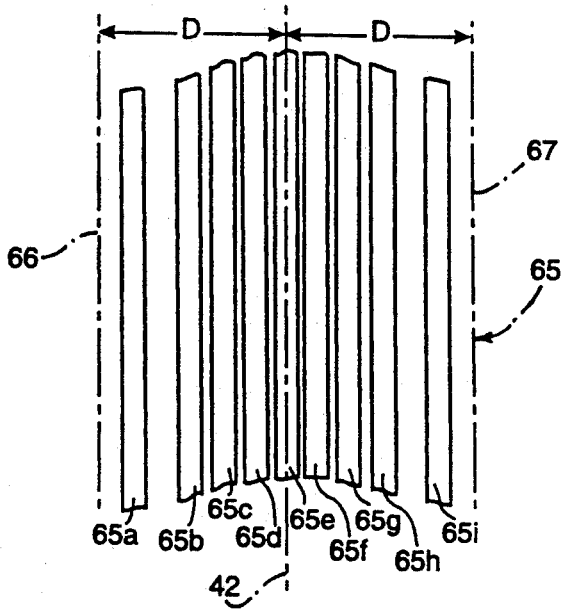
FIG. 16 is a fragmentary elevational view of a mask of the type shown in FIG. 15, but adapted to be applied directly to the outer surface of a tubular cylindrical 1.0 inch diameter lamp.

FIGS. 15 and 16 show cylindrical masks which resemble the planar mask shown in FIG. 13. The mask 62 shown in FIG. 15 comprises an array of ten spaced opaque strips, such as of opaque vinyl or metal film. When this mask is applied to the surface of a type T12 (1.5 inch diameter) lamp, it is cylindrical in shape and provides the masking effect illustrated by the curve 5*b* in FIG. 5.

The strips 62*a* to 62*j* in FIG. 15 are each about 0.100 inch wide and all of them are spaced laterally from each other and from axis 42. The innermost strips 62*e* and 62*f* have their centerlines spaced from axis 42 a distance of about 0.09 inch. The masks 62*d* and 62*g* have their centerlines spaced about 0.27 inch from the axis 42, and the strips 62*e* and 62*h* have their centerlines spaced about 0.45 inch from said axis. The strips 62*b* and 62*i* have their centerlines spaced from axis 42 a distance of 0.65 inch, and the strips 62*a* and 62*j* have their centerlines spaced from said axis a distance of about 0.95 inch.

It will be apparent that the strips 62*c*, 62*d*, 62*e*, 62*f*, 62*g* and 62*h* in the midsection of mask 62 are spaced apart equally at 0.08 inch, whereas the strips 62*b* and 62*c*, as well as the strips 62*h* and 62*i* are spaced apart 0.10 inch. The outer strip 62*a* and strip 62*b*, as well as outer strip 62*j* and strip 62*i* are spaced apart 0.20 inch. The number of strips, the strip width, and the spacing of the strip centerlines from the mask axis 42 were mathematically derived from the opacity curve 5*b* in FIG. 5.

The mask 65 shown in FIG. 16 comprises an array of nine spaced opaque strips 65*a* to 65*i* of the type used in mask 62 in FIG. 15, each of which is about 0.100 inch wide. When mask 65 is applied to the surface of a type T8 (1.0 inch diameter) lamp, it is cylindrical in shape and provides the masking effect illustrated by curve 5*c* in FIG. 5. The middle strip 65*e* of mask 65 is bisected by axis 42, and adjacent strips 65*d* and 65*f* have their centerlines spaced about 0.14 inch from said axis. Strips 65*c* and 65*g* have their centerlines spaced about 0.28 inch from axis 42, and strips 65*b* and 65*h* have their centerlines spaced about 0.43 inch from said axis. Strips 65*a* and 65*i* have their centerlines spaced about 0.67 from axis 42.

It will be apparent that, as in the mask 62 on FIG. 15, the midsection strips are generally equally spaced, i.e., adjacent strips 65*c*, 65*d*, 65*e*, 65*f* and 65*g* are all spaced apart substantially equally at about 0.04 inch, whereas the outer strips are spaced apart at increasing distances. The strips 65*b* and 65*c*, as well as strips 65*g* and 65*h*, are spaced apart about 0.05 inch, whereas the strips 65*a* and 65*b*, as well as strips 65*h* and 65*i*, are spaced apart about 0.14 inch. The number of strips, the strip width, and the spacing of the strip centerlines from the mask axis 42 were mathematically derived from the opacity curve 5*c* in FIG. 5.

It has been found that the width of the linear mask strips can be any convenient dimension up to about one half of the radius of the associated lamp. Thus, the strip width for use with a T12 lamp can be up to about 0.375 inch, whereas the width of the strips used with a T8 lamp can be up to about 0.25 inch.

Application of a non self supporting mask of the present invention to a selected Plexiglas panel or tubular lamp can be facilitated by applying an aggressive adhesive to one side thereof and applying a less aggressive adhesive to the opposite side thereof. The mask can be prefabricated by applying the less aggressive adhesive side thereof to a suitable supporting web or band.

The supporting web, with the mask carried thereby, is then applied to the full length of the surface of a supporting panel, or directly to the full length of the light emitting portion of a lamp, so that the mask is adhered firmly thereto by means of the aggressive adhesive. When the mask is thus adhered in operative position on the panel or lamp, the supporting web can be peeled therefrom without disturbing the mask. By this procedure the mask can be applied to a panel or lamp in one operation without the need to handle and apply individual element means or strips during such application.

In the embodiment of the invention shown in FIG. 2, the lamp axis to display panel distance is about 3.5 inches with lamp 24, and about 3.95 inches with the lamp 24*a*. The vertex 58 to display panel distance is about 4.9 inches, and the intercept of the planes 45 and 46 with the display panel is about 6.4 inches, the latter being 65 percent of a standard 10 inch lamp axis separation distance. Testing has shown that suitably uniform brightness is also obtained when the lamp axis to display panel distance is increased to 3.75 inches for lamp 24 or 4.15 inches for lamp 24*a*, and/or the lamp separation distance is within the range of from 8 to 11 inches. With lamp separation greater than 11 inches, a darker zone begins to appear between the lamps, even though the brightness in the intercept zone may be uniform.

Fluorescent lamps are manufactured in three luminous output ranges, all of which are useful in the present invention. The standard (STD) single phosphor G.E. Trimline type fluorescent lamp produces 645 lumens per foot, the high output (HO) single phosphor G.E. Trimline type fluorescent lamp produces 900 lumens per foot, and the Hearthglow TM triphosphor type fluorescent lamp sold by the Radiant Lamp Company produces 625 lumens per foot. Of these lamps, the triphosphor type lamps mentioned earlier herein are presently preferred because of the improved color rendering provided thereby. The Osram T8/FO lamps mentioned earlier herein are Trichrome Phosphor lamps and have lumen output comparable to that of the above-mentioned lamps, as well as improved color rendition.

Overall brightness of a light box is determined by the lamp type selected and the spacing between the lamps. As lamp spacing is increased, brightness levels decrease. As lamp spacing is increased, the lamp-to-front panel distance must be increased proportionately in order to retain uniform light intensity.

In addition to the uniform illumination provided by the invention, the construction thereof is substantially lighter in weight, substantially shallower in depth and substantially lower in cost than conventional backlit displays of similar size.

The variable opacity light leveling masks of the invention provide illuminance of the display panel of a light box and of a image thereon which exhibits brightness variations of no more than plus or minus 2.5 percent. As mentioned earlier herein, variations in brightness within this range are not discernable to the human eye. The surface brightness of the lamps can vary 5 to 10 percent without adversely affecting external viewing when the lamps are spaced apart as described herein.

While the invention is disclosed herein in terms of specific convenient parameters, various changes and modifications may be made in the illustrated embodiments without departing from the spirit of the invention. All of such changes and modifications are contemplated as may come within the scope of the appended claims.

I claim:

1. In combination, at least one elongated cylindrical fluorescent lamp or the like in spaced parallel relation with a generally planar diffusely light transmissive image bearing display panel, and means for leveling the brightness of illumination of said display panel by light flux from said at least one lamp, said means comprising a wall adjacent the side of said lamp opposite said display panel and having a generally planar diffusely light reflective surface facing and parallel with said lamp and display panel; and a variable opacity mask disposed between said lamp and display panel and having a central longitudinal axis lying in a plane which is normal to said display panel and includes therein said lamp axis, said mask having margins substantially equally spaced laterally from and generally parallel with said longitudinal axis, said mask having an opacity along its longitudinal axis which is effective to block a predetermined first percentage of light flux from said lamp directed thereat, the opacity of said mask being symmetrically reduced at increasing lateral distances from said longitudinal axis, reaching substantially zero at said mask margins, and at points thereon spaced about 75 percent of the lateral distance from said longitudinal axis to each of said mask margins, said mask has an opacity which is effective to block from about 57 percent to about 67 percent of the amount of light flux blocked at its longitudinal axis, the light flux projected toward said display panel from the side of said lamp facing said display panel, together with the light flux projected from the opposite side of said lamp toward said diffusely light reflective planar wall surface and reflected by the latter toward said display panel, providing illumination of said display panel at a level of uniformity in which variations in light intensity area of the order of about plus or minus 1.5 percent from a mean value.

2. The combination of claim 1 wherein said mask is generally planar and said first percentage is from about 25 percent to about 31 percent.

3. The combination of claim 1 wherein said lamp has a diameter of about 1.5 inch, said mask conforms to the external surface of said lamp, and said first percentage is from about 55 percent to about 61 percent.

4. The combination of claim 1 wherein said lamp has a diameter of about 1.0 inch, said mask conforms to the external surface of said lamp, and said first percentage is from about 75 percent to about 81 percent.

5. The combination of claim 1 wherein said mask comprises an array of like light blocking element means projecting laterally in opposite directions from said longitudinal axis to said mask margins, each of said element means having a net width parallel with said axis which is greatest at said axis and which is reduced at increasing lateral distances from said axis, reaching substantially zero at said margins, said element means at about 75 percent of the lateral distance from said longitudinal axis to each of said mask margins having a net width which is from about 57 percent to about 67 percent of the net width thereof at said axis.

6. The combination of claim 5 wherein each of said element means has associated therewith a net clear area which, with said element means, defines a rectangular zone having a length equal to that of said element means and a width of not more than about 2.5 inches, the net dimension of said clear area parallel with said longitudinal axis being gradually increased as the net width of said element means parallel with said longitudinal axis is reduced at increasing distances on each side of said axis, said element means being arranged along said longitudinal axis with their rectangular zones in abutting side by side relation.

7. The combination of claim 6 wherein the length of each element means is from about 1.6 inches to about 4.5 inches, and the net width of each element means along said longitudinal axis is from about 25 percent to about 31 percent of the width of its rectangular zone.

8. The combination of claim 6 wherein the net width of each element means parallel with said longitudinal axis at points located about 75 percent of the distance from said axis toward each end of said element means is from about 57 percent to about 67 percent of the net width of said element means along said axis.

9. The combination of claim 6 wherein said element means are generally lenticular in shape.

10. The combination of claim 1 in said mask comprises a plurality of light blocking portions which are spaced apart in a direction generally parallel with said longitudinal axis to provide intervening clear areas therebetween.

11. The combination of claim 1 in which said mask comprises a plurality of light blocking portions which are spaced apart in a direction generally normal to said longitudinal axis to provide intervening clear areas therebetween.

12. The combination of claim 1 wherein at least a portion of said mask comprises a layer of light blocking material having apertures through which light flux can pass.

13. The combination of claim 3 wherein said mask is mounted on a generally planar substantially clear and colorless carrier.

14. The combination of claim 1 in which said mask has a white, diffusely light reflective surface.

15. The combination of claim 5 wherein the net width each element means at points located about 75 percent of the distance from said axis toward each end thereof provides said mask an opacity thereat effective to block from about 15 percent to about 21 percent of light flux directed thereat.

16. The combination of claim 1 in which said mask is made of material which is from zero percent to about 50 percent transmissive of light.

17. The combination of claim 1 in which said mask is made of metal.

18. The combination of claim 5 wherein at least some of said element means are connected to each other to form a unitary structure.

19. The combination of claim 1 in which said mask is formed at least in part of opaque film which is provided with adhesive means by which it is attached in laminar relation to a supporting surface.

20. The combination of claim 3 in which said mask comprises sheet material adhered in laminar relation to the surface of said lamp.

21. The combination of claim 4 in which said mask comprises sheet material adhered in laminar relation to the surface of said lamp.

22. The combination of claim 1 wherein said mask opacity is provided by light blocking particles dispersed within a light transmissive matrix.

23. The combination of claim 40 wherein each said mask is substantially planar and is mounted substantially parallel with said display panel.

24. The combination of claim 23 wherein each said mask is mounted on an elongated generally planar clear colorless plate substantially parallel with said display panel, and a fixed relationship between each lamp and its mask is maintained by a plurality of spaced parallel plates apertures to receive said lamp and attached in normal relation to the respective mask supporting plate.

25. The combination of claim 23 wherein the transverse dimension between the margins of each mask subtends an angle tangent to its associated lamp within the range of from about 31 degrees to about 37 degrees on each side of said plane which includes the axis of said lamp and is normal to said display panel.

26. The combination of claim 23 in which said at least one lamp has a diameter of about 1.5 inches, the transverse dimension between the margins of each mask is from about 2.85 to about 4.5 inches, and each said mask is spaced from the axis of its associated lamp a distance of from about 0.75 to about 2.0 inches.

27. The combination of claim 23 in which said at least one lamp has a diameter of about 1.0 inch, the transverse dimension between the margins of each mask is from about 1.95 to about 3.9 inches, and each mask is spaced from the axis of its associated lamp a distance of from about 0.5 to about 2.0 inches.

28. The combination of claim 40 wherein at least some of said masks overlay the outer surface of the associated lamp in generally coaxial relation therewith.

29. The combination of claim 28 wherein the transverse dimension between the margins of said mask is substantially equal to one half the outer circumferential dimension of the associated lamp.

30. The combination of claim 28 wherein said at least one lamp has a diameter of about 1.5 inches, and said mask has an opacity along said longitudinal axis effective to block from about 55 percent to about 61 percent of light flux directed thereat.

31. The combination of claim 28 wherein said at least one lamp has a diameter of about 1.0 inch, and said mask has an opacity along said longitudinal axis effective to block from about 75 percent to about 81 percent of light flux directed thereat.

32. The combination of claim 30 wherein at about 75 percent of the lateral distance from said longitudinal axis to each mask margin the opacity of said mask is effective to block from about 32 to about 38 percent of light flux directed thereat.

33. The combination of claim 31 wherein at about 75 percent of the lateral distance from said longitudinal axis to each mask margin the opacity of said mask is effective to block from about 44 percent to about 50 percent of light flux directed thereat.

34. The combination of claim 40 wherein each said mask comprises an array of light blocking element means projecting laterally in opposite directions from said longitudinal axis to said mask margins, each of said element means having a net width parallel with said axis which is greatest at said axis and which is reduced at increasing lateral distances from said axis, reaching substantially zero at said margins.

35. The combination of claim 40 wherein the axes of said lamp and said mask are spaced apart a distance of from about 0.5 inches to about 2.0 inches.

36. The combination of claim 34 wherein each of said element means has associated therewith a net clear area which, with said element means defines a rectangular zone having a length equal to that of said element means and a width of not more than about 2.5 inches, the net dimension of each said clear area in a direction parallel with the longitudinal axis being gradually increased as the net width of said element means parallel with said longitudinal axis is reduced at increasing distances on each side of said axis, said element means being arranged along said longitudinal axis with their rectangular zones in abutting side by side relation.

37. The method of producing illumination of a planar diffusely light transmissive display panel or the like at a level of uniformity in which variations in light intensity are of the order of about plus or minus 1.5 percent from a mean value using light flux from at least four equally spaced parallel elongated tubular lamps having their axes parallel with said display panel, said method comprising the steps of blocking a predetermined first percentage of the light flux projected from each of said lamps toward said display panel along planes including said lamp axes and which are normal to said display panel; blocking at attenuated levels light flux projected from said lamps toward said display panel at successively greater distances on each side of the respective planes normal to said display panel up to predetermined maximum distances beyond which said light flux from said lamps is substantially unobstructed, said attenuation being effective, with respect to light flux directed toward points on said display panel located about 75 percent of the distance from the respective planes to said maximum distances, to block an amount thereof equal to about 57 percent to about 67 percent of the amount of light flux blocked at said planes, and diffusely reflecting toward said display panel light flux projected from said lamps in directions other than toward said display panel.

38. The method of claim 37 wherein said blocking of light flux is accomplished by the use of planar masking means, and said first percentage of light blocked is from about 25 percent to about 31 percent.

39. The method of claim 37 wherein said predetermined maximum distances correspond to angles tangent to said lamp within the range of from about 31 degrees to about 37 degrees on each side of said planes which include the axes of said lamps and are normal to said display panel.

40. A fluorescent backlit display adapted for illumination of relatively large format imagery, comprising in combination, a rectangular light box having top and bottom walls, opposing side walls and a back wall, said walls having diffusely light reflective inner surfaces and said light box having generally coplanar front edge portions; a rectangular generally planar relatively thin diffusely light transmissive display panel having marginal portions in registration with and attached to said light box front edge portions in generally parallel spaced relation with said back wall; a plurality of four or more equally spaced parallel cylindrical fluorescent lamps mounted adjacent said back wall with their axes in generally parallel spaced relation with and between the latter and said display panel; a variable opacity light leveling mask associated with each of said lamps and mounted between its associated lamp and said display panel, each said mask having a longitudinal axis located in a plane normal to said display panel which includes therein the axis of the associated lamp, each said mask having opposite margins spaced laterally from and parallel with its longitudinal axis and having an opacity along its longitudinal axis effective to block a first percentage of the light flux from its associated lamp directed thereat, the opacity of each mask being symmetrically reduced at increasing lateral distances from its longitudinal axis, reaching substantially zero at said mask margins, the opacity of each mask at points thereon spaced about 75 percent of the lateral distance from its longitudinal axis toward the margins thereof is from about 57 percent to about 67 percent of the opacity thereof at said longitudinal axis, the light flux projecting directly from said lamps, toward said display panel through an between said masks, together with light flux from said lamps reflected toward said display panel by the diffusely reflective light box inner wall surfaces, providing illumination of said display panel at a level of uniformity in which variations in light intensity are of the order of about plus or minus 1.5 percent from a mean value.

41. The method of claim 37 wherein said lamps have a diameter of about 1.5 inch, said blocking of light flux is accomplished by the use of masking means conforming to the external surface of said lamps, and said first percentage of light flux blocked is from about 55 percent to about 61 percent.

42. The method of claim 37 wherein said lamps have a diameter of about 1.0 inch, said blocking of light is accomplished by the use of masking means conforming to the external surface of said lamp, and said first percentage of light blocked is from about 75 percent to about 81 percent.

43. The combination of claim 40 wherein said masks are generally planar and said first percentage is from about 25 percent to about 31 percent.

44. The combination of claim 40 wherein said lamps each have a diameter of about 1.5 inch, said masks conform to the external surface of said lamps, and said first percentage is from about 55 percent to about 61 percent.

45. The combination of claim 40 wherein said lamps have a diameter of about 1.0 inch, said masks conform to the external surface of said lamps, and said first percentage is from about 75 percent to about 81 percent.

46. The combination of claim 40 wherein the intensity of illumination of said display panel by said lamps is of the order of 300 foot lamberts.

47. The combination of claim 40 wherein the spacing between said lamp axes is about twice the spacing between said inner back wall surface and said display panel.

48. The combination of claim 47 wherein the spacing between said lamp axes is about 10 inches, and the spacing between said inner back wall surface and said display panel is about 5 inches.

49. The combination of claim 40 wherein the spacing between the axes of said lamps and said back wall inner surface is about 1.5 inches, and the spacing between said axes and said display panel is about 3.5 inches.

50. The combination of claim 40 wherein said display panel is formed of a flexible image bearing white film or fabric which is readily removably attached to the front edge portions of said light box, forming therewith an enclosure resistant to entry of dust laden air.

* * * * *